US012319467B2

(12) United States Patent
Piech

(10) Patent No.: US 12,319,467 B2
(45) Date of Patent: Jun. 3, 2025

(54) CAN LID AND METHOD FOR PRODUCING A CAN LID

(71) Applicant: Top Cap Holding GmbH, Kufstein (AT)

(72) Inventor: Gregor Anton Piech, Scheffau am Wilden Kaiser (AT)

(73) Assignee: TOP CAP HOLDING GmbH, Kufstein (AT)

( * ) Notice: Subject to any disclaimer, the term of this patent is extended or adjusted under 35 U.S.C. 154(b) by 50 days.

(21) Appl. No.: 18/247,827

(22) PCT Filed: Oct. 27, 2021

(86) PCT No.: PCT/EP2021/079824
§ 371 (c)(1),
(2) Date: Apr. 4, 2023

(87) PCT Pub. No.: WO2022/090310
PCT Pub. Date: May 5, 2022

(65) Prior Publication Data

US 2023/0331435 A1 Oct. 19, 2023

(30) Foreign Application Priority Data

Oct. 29, 2020 (DE) ..... 102020128491.8

(51) Int. Cl.
*B65D 17/28* (2006.01)
*B21D 51/44* (2006.01)
*B21D 51/46* (2006.01)

(52) U.S. Cl.
CPC ..... *B65D 17/4014* (2018.01); *B21D 51/443* (2013.01); *B21D 51/46* (2013.01); *B65D 2517/5062* (2013.01)

(58) Field of Classification Search
CPC ..... B65D 17/4014; B65D 2517/5062; B65D 2517/00; B65D 2517/0002;
(Continued)

(56) References Cited

U.S. PATENT DOCUMENTS 3,374,921 A * 3/1968 Kelley ..... B65D 17/506 D9/443
3,410,436 A 11/1968 Foss et al.
(Continued)

FOREIGN PATENT DOCUMENTS

CN 106458397 A 2/2017
CN 110650894 A 1/2020
(Continued)

OTHER PUBLICATIONS

International Searching Authority. International Search Report and Written Opinion for PCT Application No. PCT/EP2021/079824 and English translation, mailed Feb. 22, 2022, pp. 1-16.
(Continued)

*Primary Examiner* — Kareen K Thomas
(74) *Attorney, Agent, or Firm* — Vivacqua Crane, PLLC

(57) ABSTRACT

A can lid comprises a metallic lid surface in which an opening is formed which is bounded by a closed margin of the lid surface and which is closed by a closure piece. The closure piece is separated from the surrounding lid surface by a microgap extending at least sectionally along the margin of the lid surface. A margin of the closure piece and the margin of the surrounding lid surface adjoin one another at the microgap. The closure piece can be moved out of the plane defined by the opening to release the opening. The can lid further comprises a layer composed of a plastic material applied to a flat side of the metallic lid surface in a manner covering the microgap. The margin of the closure piece and
(Continued)

the margin of the surrounding lid surface are offset from one another transversely to the plane defined by the opening.

15 Claims, 5 Drawing Sheets

(58) Field of Classification Search
CPC .... B65D 2517/0038; B65D 2517/0058; B65D 2517/0082; B65D 2517/5008; B21D 51/443; B21D 51/46
See application file for complete search history.

(56) References Cited

U.S. PATENT DOCUMENTS

| | | | | |
|---|---|---|---|---|
| 3,499,572 | A | 3/1970 | Ruekberg | |
| 3,759,206 | A | 9/1973 | Dalli et al. | |
| 3,933,270 | A * | 1/1976 | Bozek | B65D 55/02 220/270 |
| 3,958,717 | A | 5/1976 | Ellis | |
| 4,813,837 | A | 3/1989 | Ball et al. | |
| 6,158,608 | A * | 12/2000 | Schlattl | C23D 5/02 220/253 |
| 2005/0115969 | A1 * | 6/2005 | Mizuma | B65D 17/4014 220/269 |
| 2015/0290699 | A1 | 10/2015 | Claydon | |
| 2018/0339819 | A1 | 11/2018 | Stodd | |
| 2018/0362210 | A1 * | 12/2018 | Vanderstraeten | B65D 17/4014 |
| 2019/0055053 | A1 | 2/2019 | Piech | |

FOREIGN PATENT DOCUMENTS

| | | | |
|---|---|---|---|
| CN | 112424075 | A | 2/2021 |
| DE | 2146452 | A1 | 3/1972 |
| DE | 102016103801 | A1 | 9/2017 |
| EP | 3385185 | A1 | 10/2018 |
| EP | 3584191 | A1 | 12/2019 |
| GB | 1131419 | A | 10/1968 |
| GB | 1268386 | A | 3/1972 |
| JP | H06190965 | A | 7/1994 |
| JP | H09108756 | A | 4/1997 |
| JP | 2000327043 | A | 11/2000 |
| JP | 2003095264 | A | 4/2003 |
| JP | 2020512958 | A | 4/2020 |
| KR | 20110010111 | U | 10/2011 |
| WO | 2012006739 | A1 | 1/2012 |
| WO | 2018184703 | A1 | 10/2018 |

OTHER PUBLICATIONS

Taiwan Intellectual Property Office. Search Report for TW Application No. 110139666, mailed Nov. 22, 2022.
Joliet, H. "Various Forms of Aluminum Packaging," Light Alloy Processing Technology, No. 10, 1983.
Zheng, Z. "Application of Gearbox Lip Seals," Modern Metallurgy, vol. 38, No. 2, Apr. 2010, pp. 66-67.

* cited by examiner

CAN LID AND METHOD FOR PRODUCING A CAN LID

The invention relates to a can lid, in particular for beverage cans, comprising a metallic lid surface in which an opening is formed which is bounded by a closed margin of the lid surface and which is closed by a closure piece of the metallic lid surface, wherein the closure piece is separated from the surrounding lid surface by a microgap extending at least sectionally along the margin of the lid surface, wherein a margin of the closure piece and the margin of the surrounding lid surface adjoin one another at the microgap, and wherein the closure piece can be moved out of the plane defined by the opening to release the opening; and a layer composed of a plastic material which is applied to a flat side of the metallic lid surface in a manner covering the microgap.

Can lids of this type are used on a large scale in the manufacture of beverage cans, food cans and the like. They are simple and inexpensive to manufacture, enable a space-saving stacking of similar cans and can be easily opened and, if necessary, closed again by manually moving the closure piece. Due to the microgap, an entry of metal particles into the can interior that is hazardous to health does not occur on the opening of the can. Despite the lack of a continuous metallic connection between the closure piece and the surrounding lid surface, the leak-tightness of the can lid is ensured by the layer covering the microgap.

On the moving of the closure piece out of the plane defined by the opening, the layer composed of a plastic material tears in the region of the microgap such that the opening is subsequently free. Depending on the procurement of the plastic material, a stretching of the layer and an undefined separation thereof, for example a fringing, can occur during the opening process. This is undesirable, in particular since the force effort required for opening the can is thereby increased and the exit of can contents through the opening is impeded under certain circumstances. In addition, the visual appearance of the opening is negatively influenced.

It is an object of the invention to enable an easier and more reliable opening of can lids of said kind and in particular an improved separation of the layer.

The object is satisfied by a can lid having the features of claim 1.

The invention provides that the margin of the closure piece and the margin of the surrounding lid surface are offset from one another transversely to the plane defined by the opening.

Due to the offset, one of the adjoining margins projects with respect to the other and, on the moving apart of the margins as a result of the opening process, forms a cutting edge which moves through the layer and provides a reliable and defined separation of the layer. The layer is therefore rather sheared than torn. Thus, in a can lid in accordance with the invention, the undesirable situation that the layer is stretched on the opening of the can and finally tears in an undefined manner does not occur.

The layer composed of a plastic material can be a film or a film-like layer which is connected to the metallic lid surface, for example adhesively. A film composed of a plastic material can in particular be connected to the metallic lid surface by means of lamination. The layer can also be a film laminated onto the metallic lid surface. The layer could generally also be produced by an application of a liquid plastic material and by a subsequent hardening.

The microgap can be a punched gap, wherein the adjoining margins can at least regionally contact one another. The plane defined by the opening can coincide with the surface extent of the lid surface or of the closure piece.

A step having an angular or edged cross-section can be formed in the lid surface by the offset arrangement of the margin of the closure piece and the margin of the surrounding lid surface. Such a step develops a particularly pronounced notch effect that supports the cutting through of the plastic coating.

Provision can be made that the margin of the closure piece and the margin of the surrounding lid surface are offset from one another by a height offset of 0.01 mm to 0.3 mm, preferably of 0.05 mm to 0.12 mm.

The margin of the closure piece and the margin of the surrounding lid surface can also be offset from one another by a height offset which amounts to at least 10% and at most 90%, preferably at least 25% and at most 70%, of the thickness of the metallic lid surface. With such a height offset, a clear cutting edge is formed, on the one hand, and, on the other hand, with common thicknesses of the lid surface, a sufficient overlapping of the margins is ensured in the closed state of the can.

The margin of the closure piece is preferably offset in the opening direction relative to the margin of the surrounding lid surface. It is thereby ensured that the cutting effect starts immediately on the opening of the can and a certain distance without a cutting effect does not, for instance, first have to be covered. If the layer is applied to the rear flat side of the lid surface with respect to the opening direction, the margin of the surrounding lid surface projecting to the rear acts as a cutting edge. If, in contrast, the layer is applied to the flat side of the lid surface which is the front flat side with respect to the opening direction, the margin of the closure piece projecting to the front acts as a cutting edge.

An embodiment of the invention provides that the microgap has a maximum width of 0.02 mm and/or that the closure piece is held in the surrounding lid surface by clamping. This has proven to be particularly favorable in practice.

The layer is preferably applied to an inner side of the metallic lid surface. The layer is therefore preferably located at the lid side facing the can interior. In general, this is the lower side of the metallic lid surface.

The layer can be applied over the full area to the flat side of the metallic lid surface. This is of advantage from a technical production aspect and ensures a particularly high sealing effect. The layer can be designed as a film and/or can be applied, for example sealed on, in a firmly adhering manner to the metallic lid surface. The plastic material can be polypropylene suitable for use with food.

In accordance with a further embodiment of the invention, the layer has a weakening, in particular a notch or an at least partial opening notch, which is arranged at a spacing from the microgap. The weakening reduces the force effort required for opening the can. Due to the spacing between the weakening and the microgap, a high degree of leak-tightness is ensured—even in the case that the weakening is designed as a partial or complete opening notch. In particular in the case of a partial or complete opening notch, it is advantageous if the composite of the metal and the plastic material has a particularly high quality without any significant defects.

It is preferred that a gripping, pulling and/or lever element for lifting or pivoting open the closure piece is fastened to the closure piece. A user can actuate the gripping, pulling and/or lever element to press in, raise, or pivot open the closure piece. A two-armed lever member composed of a plastic material can in particular be provided and is fixedly connected to the metallic lid surface. The gripping, pulling and/or lever element preferably has an annular grip section such as a ring tab. A ring tab is particularly advantageous in the practical handling since it can be easily gripped and enables an opening of the respective can via a pulling movement which can be carried out comfortably.

A particular embodiment of the invention provides that a sealing frame composed of a plastic material surrounding the opening is connected to the surrounding lid surface and a closure unit composed of a plastic material supporting the closure piece is pivotably attached to the surrounding lid surface, with the sealing frame and the closure unit being releasably connected in a fluidtight manner to one another via sealing and latching ribs and associated reception grooves. Such a can lid has a reclosable opening. The sealing and latching ribs as well as the reception grooves are preferably designed such that a complete reclosing by the snap-in connection can be felt and, if necessary, perceived acoustically.

The invention also relates to a method of manufacturing a can lid, in particular a can lid for beverage cans, preferably a can lid as described above, wherein an at least regionally areal metal element is provided, a closure piece is punched out of the metal element and is reinserted into the opening formed by the punching process, and wherein a layer composed of a plastic material is applied to a flat side of the metal element such that the separation line between the punched-out closure piece and the opening is covered by the layer.

In accordance with the invention, on or after the insertion of the closure piece into the opening, a predefined height offset is produced between a margin of the closure piece and an adjoining margin of the opening in a direction facing transversely to the plane defined by the opening.

Due to the height offset, one of the adjoining margins forms a cutting edge which moves through the layer on the opening of the can and ensures a reliable and defined separation of the layer via a notch effect.

In a conventional method of manufacturing a can lid, a displacement of the adjoining margins likewise occurs during the punching since the closure piece is first pressed out of the metal element. However, this is a temporary transitional state which inevitably occurs due to the punching process. In contrast, the invention provides a carrying out of a targeted positioning of the adjoining margins in order to generate a permanent height offset until the first opening of the can.

The closure piece is preferably incompletely moved back into the opening in order to generate the height offset. This is advantageous from a technical process aspect.

In accordance with an embodiment of the invention, the height offset is set and/or fixed in a calibration unit after the incomplete moving back. Due to a suitable calibration, the respective margins can be positioned relative to one another with a high degree of precision.

The application of the layer to the flat side of the metal element is preferably performed after the generation of the height offset while maintaining said height offset. Thus, damage to the layer by the apparatus used to generate the height offset is excluded.

Further developments of the invention can also be seen from the dependent claims, from the following description and from the enclosed drawing.

The invention will be described in the following by way of example with reference to the drawing.

Figure 1:
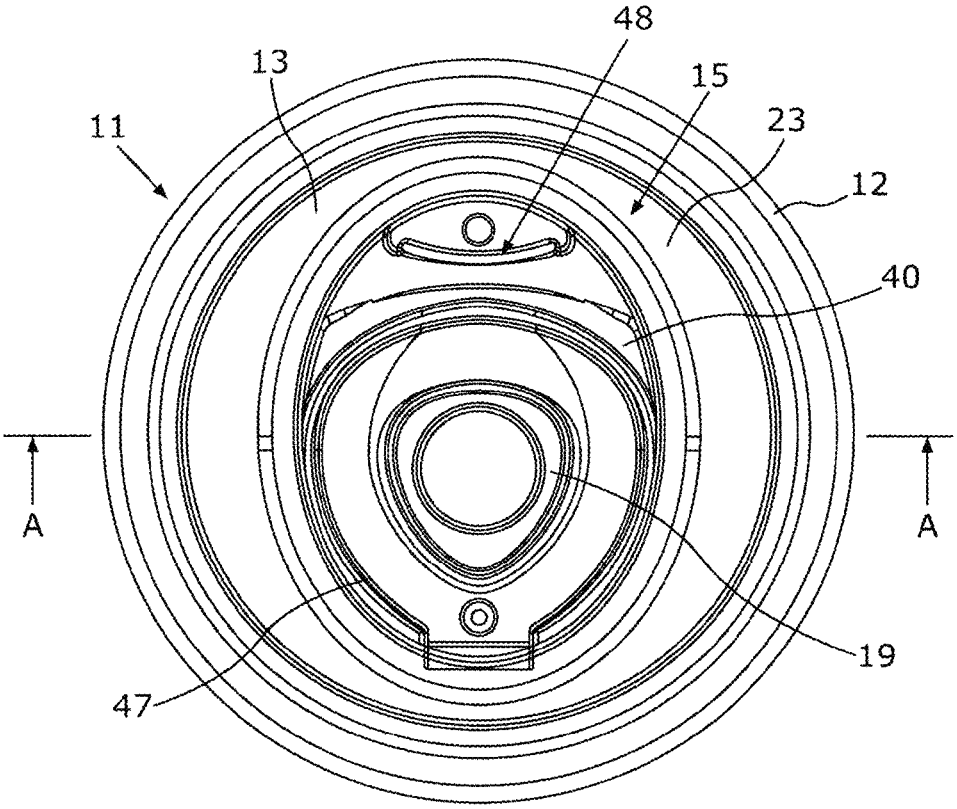
FIG. 1 is a plan view of a can lid in accordance with the invention for a beverage can.
Figure 2:
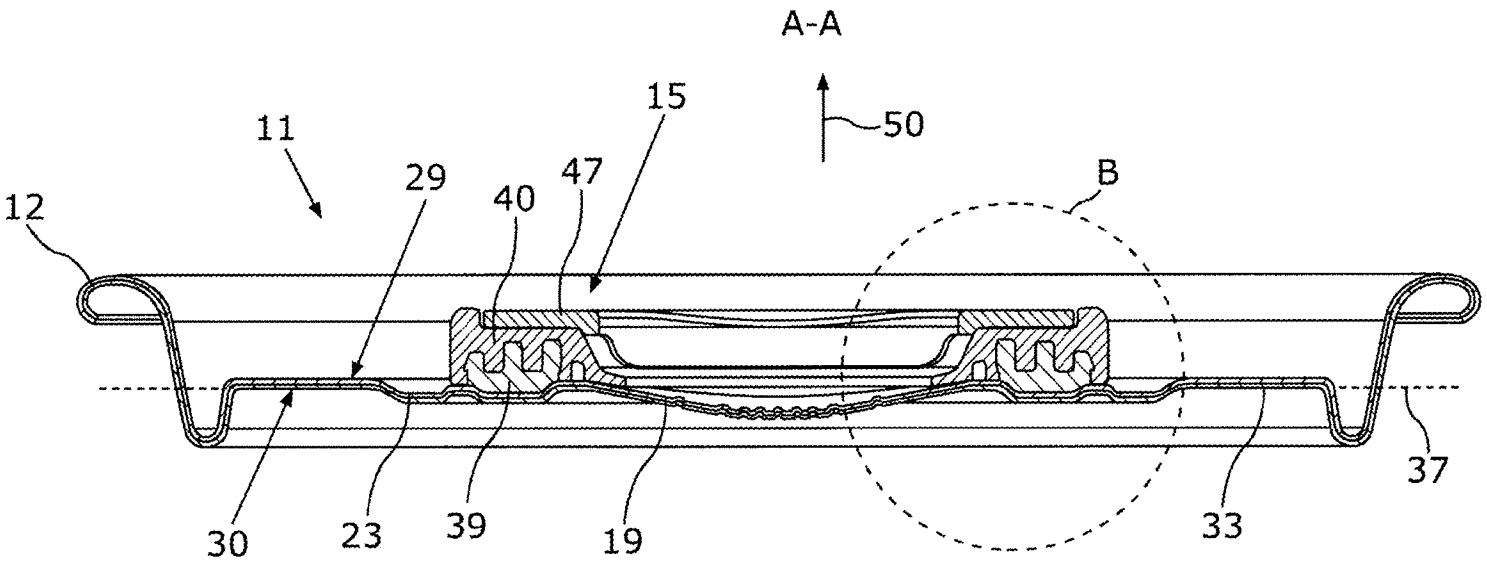
FIG. 2 is a sectional view of the can lid shown in FIG. 1 along the line A-A.

FIGS. 1 and 2 show a can lid 1 which is in particular intended for a beverage can and into whose metallic lid surface 13 a reclosable opening system 15 is integrated. The can lid 11 can be connected to an associated container, not shown, via a beaded rim 12. For this purpose, an opening is provided in the metallic lid surface 13, which opening is closed by a section of the metallic lid surface 13 in the form of a closure piece 19 in the delivery state of the can lid 11 shown in FIGS. 1 and 2.

Figure 3:
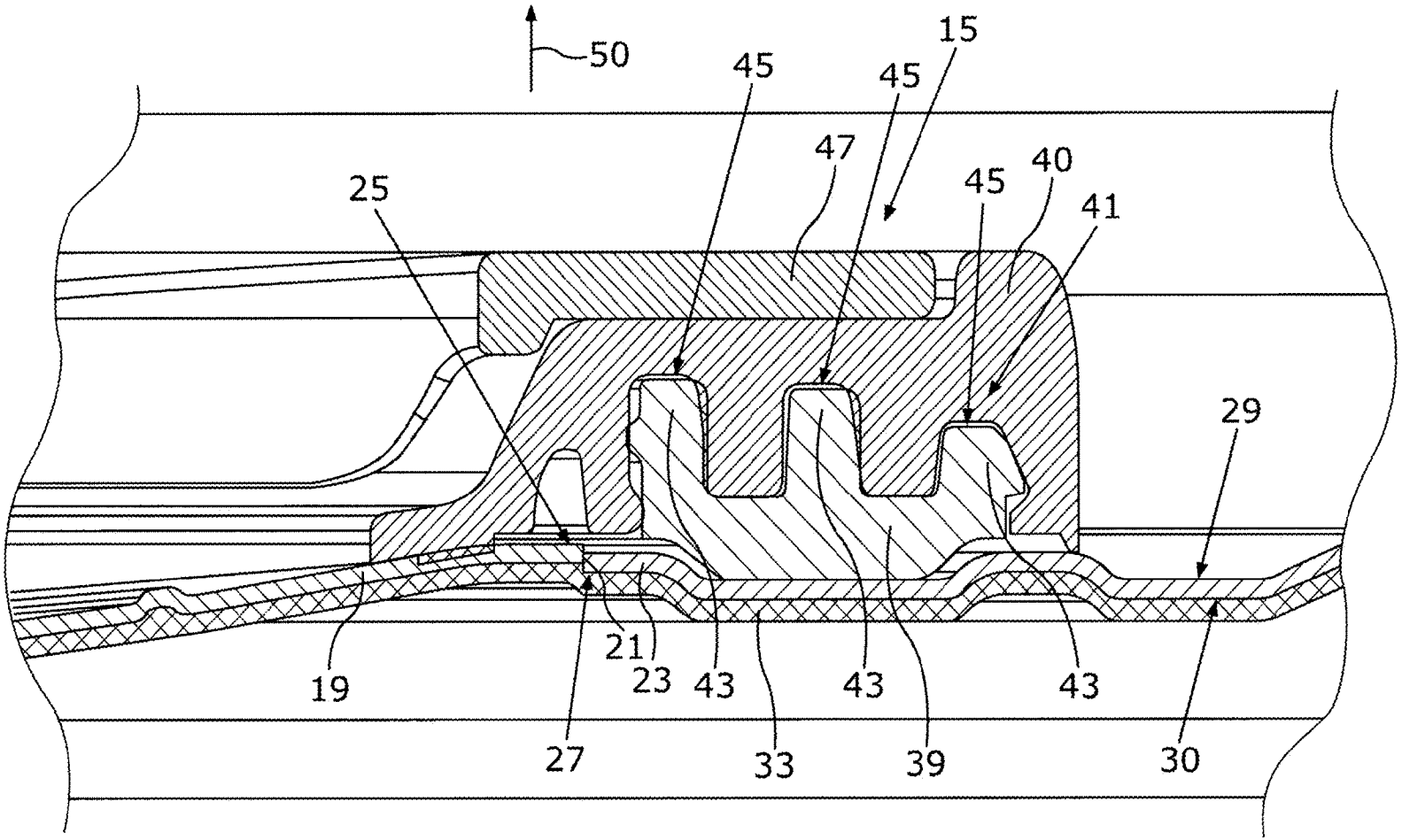
FIG. 3 is an enlarged representation of the detail B in FIG. 2.
Figure 4:
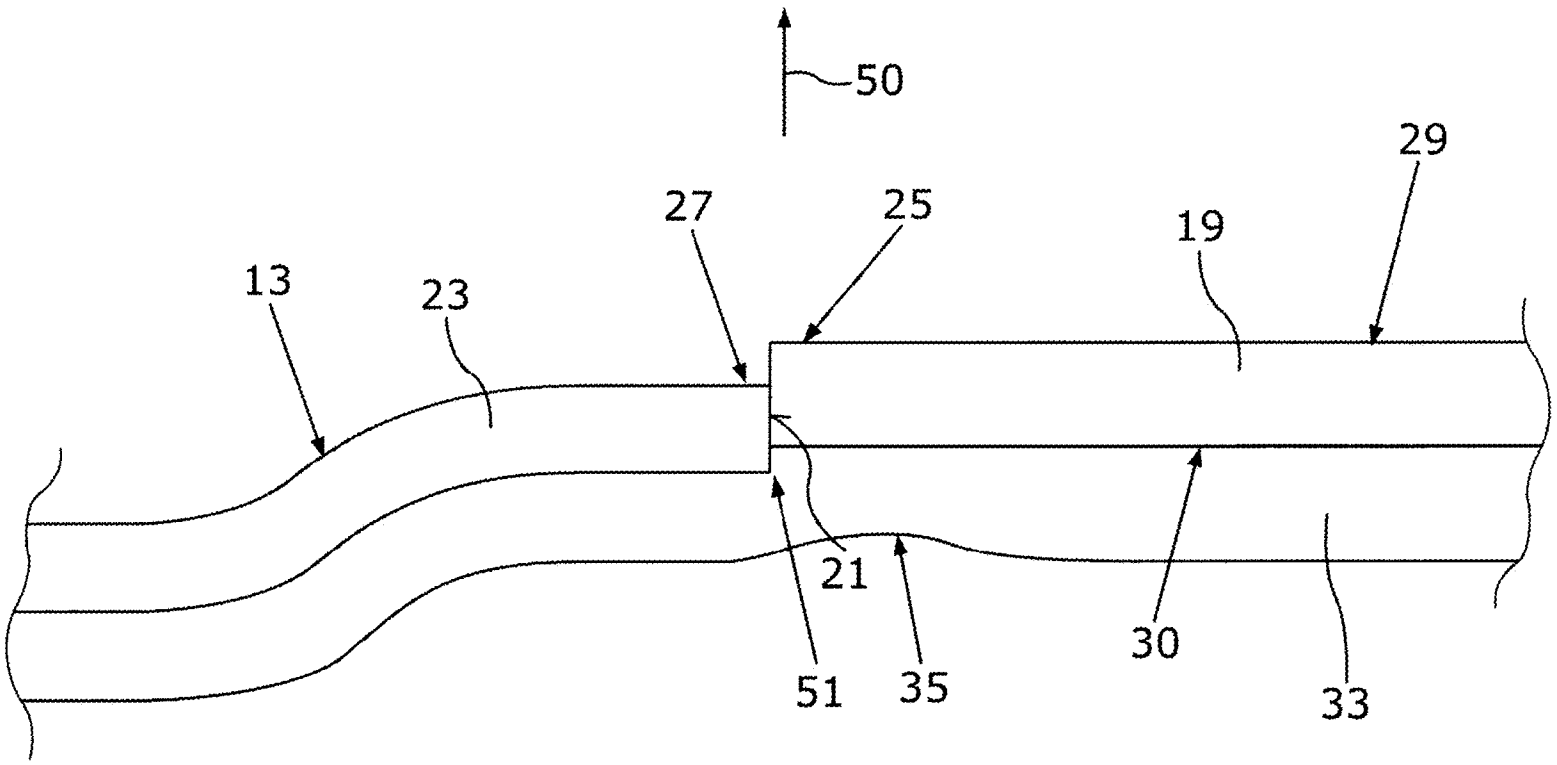
FIG. 4 is an enlarged partial sectional representation of the can lid shown in FIG. 1 that shows a height offset between the outer margin of a closure piece and the inner margin of a surrounding lid surface.

As can be recognized from FIGS. 3 and 4, the closure piece 19 is separated from the surrounding lid surface 23 by a microgap 21. In the region of the microgap 21, the outer margin 25 of the closure piece 19 and the inner margin 27 of the surrounding lid surface 23 adjoin one another.

The metallic lid surface 13 is preferably formed from a sheet metal layer composed of aluminum or tin plate. It has an outer flat side 29 and an inner flat side 30, wherein a layer 33 composed of a plastic material is applied to the inner flat side 30 such that it covers the microgap 21. An adhesive coating layer, not visible in the Figures, can be provided for a fixed connection of the layer 33 to the metallic lid surface 13. In the embodiment example shown, the layer 33 is applied over the full area to the inner flat side 30 of the metallic lid surface 13. In certain applications, it could also be sufficient to provide a layer 33 only in the environment of the microgap 21. The layer 33 can be a plastic film, for example, composed of propylene. A notch 35 can be formed in the layer 33, as shown in FIG. 4, and extends along the microgap 21 at a predefined spacing therefrom.

The can lid 11 can be opened by moving the closure piece 19 out of the plane 37 defined by the opening (FIG. 2). Since there is no bonded connection between the closure piece 19 and the surrounding lid surface 23 in the region of the microgap 21, no metal separation of any kind has to take place on the first opening of a can provided with the can lid 11 in accordance with the invention so that the otherwise unavoidable formation of metallic microparticles is excluded. This avoidance of the creation of microparticles in the opening process, in particular microparticles composed of aluminum, is of importance under health aspects since such microparticles unavoidably also enter into the product contained in the respective can and thus also into the human body.

The layer 33 reliably seals the microgap 21. The notch 35, which can have a uniform depth or, if applicable, can also locally have different depths, ensures that only a comparatively small force is required to open the can lid 11. The spacing between the microgap 21 and the notch 35, which preferably amounts to approximately 0.2 to 0.5 millimeters, improves the sealing effect.

The reclosable opening system 15 (FIGS. 1-3) comprises a sealing frame 39 composed of a plastic material which surrounds the opening and which is fixedly connected to the surrounding lid surface 23. A closure unit 40 composed of a plastic material supporting the closure piece 19 is further provided and is pivotally attached to the surrounding lid surface 23. A releasable fluid-tight connection between the sealing frame 39 and the closure unit 40 is made possible by means of a latch device 41 (FIG. 3) that is formed by sealing and latching ribs 43 and associated reception grooves 45. The can lid 11 is therefore reclosable.

A tear-open member 47 that is annular here, preferably likewise composed of plastic, is connected to or directly molded to the closure unit 40 and is accordingly fastened to the closure piece 19. By pulling at the tear-open member 47, a user can pivot the closure piece 19 upwardly out of the plane 37 defined by the opening and can thus release the opening while separating the layer 33. A molded-on pivot bearing 48 (FIG. 1) is formed at the closure unit 40 in a manner disposed diametrically opposite the closure unit 40 and is fixedly connected to the surrounding lid surface 23.

As can be seen from FIGS. 3 and 4, in the delivery state of the can lid 11, the outer margin 25 of the closure piece 19 and the inner margin 27 of the surrounding lid surface 23 are offset from one another transversely to the plane 37 defined by the opening. The corresponding height offset can amount to 0.01 mm to 1 mm and/or at least 10% and at most 90% of the thickness of the metallic lid surface 13. In the variant shown, the outer margin 25 of the closure piece 19 is offset in the opening direction 50, i.e. upwardly in FIGS. 3 and 4. Due to the offset, a step 51 or an edge is formed in the plastic material of the layer 33 at the inner flat side 30 of the metallic lid surface 13.

On the first opening of the can, a user pulls at the tear-open member 47 and thereby upwardly pivots the closure unit 40 with the closure piece 19. In this respect, the latch connection between the closure unit 40 and the sealing frame 39 is released. The step 51 furthermore cuts through the layer 33 and separates it precisely along the microgap 21. The contents of the can be removed by the opening produced. When the closure unit 40 with the closure piece 19 is pivoted back again, the latch connection between the closure unit 40 and the sealing frame 39 is established again such that the opening is sealed tightly again despite the separated layer 33. The opening and closing can be repeated as often as desired.

The effect of the offset margins 25, 27 is independent of the presence of the latch device 41 and of the opening direction 50. Therefore, the described height offset is also advantageous for can lids which cannot be closed again without a sealing frame and a closure unit, i.e. for standard can lids, as well as for can lids having a closure piece 19 which is to be pivoted inwardly.

To manufacture a can lid 11 in accordance with the invention, an areal metal element, for example a sheet metal layer composed of aluminum or tinplate, is provided and is fed to an embossing apparatus in which the beaded rim 12 or parts thereof as well as grooves, reinforcement beads and the like are molded into the areal metal element. The stamped metal element is fed to a punching apparatus in which the closure piece 19 is punched out of the metal element and reinserted into the opening formed by the punching process. Specifically, in the course of the return stroke of the punching die, the punched-out closure piece 19 is immediately pressed directly into the sheet metal layer again by a spring force and is held there in a force-fitted manner. To generate a predefined height offset between the margin of the closure piece 19 and the adjoining margin of the opening in a direction facing transversely to the plane defined by the opening, the closure piece 19 is, however, incompletely moved back into the opening in this respect.

The metal element is then fed to a calibration device in which the height offset is set and/or fixed after the incomplete moving back. Only then is the inner flat side 30 provided with the layer 33, wherein the application of the layer is performed such that the height offset is maintained. The embossing apparatus, the punching apparatus, and the calibration apparatus can, if necessary, be integrated into a progressive die together with further processing devices.

Figure 5:
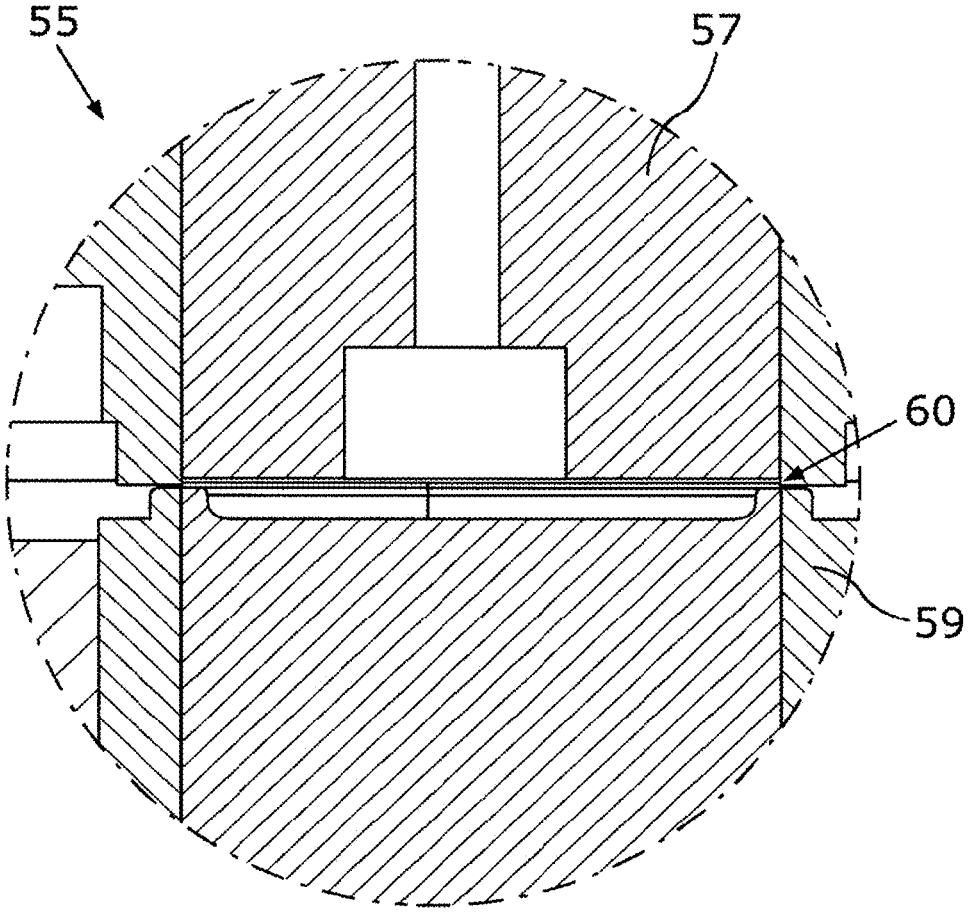
FIG. 5 is a lateral sectional representation of an apparatus for setting and/or fixing a height offset as shown in FIG. 4.

FIG. 5 shows a tool 55 of a calibration apparatus that is suitable for setting the height offset. In this respect, an arrangement of a punch 57 and a die 59 defines a predefined height difference 60.

REFERENCE NUMERAL LIST

11 can lid
12 beaded rim
15 reclosable opening system
19 closure piece
21 microgap
23 surrounding lid surface
25 outer margin
27 inner margin
29 outer flat side
30 inner flat side
33 layer
35 notch
37 plane
39 sealing frame
40 closure unit
41 latch device
43 sealing and latching rib
45 reception groove
47 tear open member
48 pivot bearing
50 opening direction
51 step
55 tool
57 punch
59 die
60 height difference

The invention claimed is:

1. A can lid comprising:

a metallic lid surface in which an opening is formed which is bounded by a closed margin of the metallic lid surface and which is closed by a closure piece of the metallic lid surface, wherein the closure piece is separated from a surrounding metallic lid surface by a microgap extending at least sectionally along the closed margin of the metallic lid surface, wherein a margin of the closure piece and a margin of a surrounding portion of the metallic lid surface adjoin one another at the microgap, and wherein the closure piece can be moved out of a plane defined by the opening to release the opening;

a layer composed of a plastic material which is applied to a flat side of the metallic lid surface in a manner covering the microgap; and wherein the margin of the closure piece and the margin of the surrounding metallic lid surface are offset from one another transversely to the plane defined by the opening.

2. The can lid in accordance with claim 1, wherein a step having an angular or edged cross-section is formed in the metallic lid surface by an offset arrangement of the margin of the closure piece and the margin of the surrounding metallic lid surface.

3. The can lid in accordance with claim 1, wherein the margin of the closure piece and the margin of the surrounding metallic lid surface are offset from one another by a height offset of 0.01 mm to 0.3 mm.

4. The can lid in accordance with claim 1, wherein the margin of the closure piece and the margin of the surrounding metallic lid surface are offset from one another by a height offset which amounts to at least 10% and at most 90% of a thickness of the metallic lid surface.

5. The can lid in accordance with claim 1, wherein the margin of the closure piece is offset in an opening direction relative to the margin of the surrounding metallic lid surface.

6. The can lid in accordance with claim 1, wherein the microgap has a maximum width of 0.02 mm.

7. The can lid in accordance with claim 1, wherein the layer is applied to an inner side of the metallic lid surface.

8. The can lid in accordance with claim 1, wherein the layer is applied over a full area to the flat side of the metallic lid surface.

9. The can lid in accordance with claim 1, wherein the layer has a weakening which is arranged at a spacing from the microgap.

10. The can lid in accordance with claim 1, wherein a gripping, pulling and/or lever element for lifting or pivoting open the closure piece is fastened to the closure piece.

11. The can lid in accordance with claim 1, wherein a sealing frame composed of a plastic material surrounding the opening is connected to the surrounding metallic lid surface and a closure unit composed of a plastic material supporting the closure piece is pivotably attached to the surrounding metallic lid surface, with the sealing frame and the closure unit being releasably connected in a fluidtight manner to one another via sealing and latching ribs and associated reception grooves.

12. The can lid in accordance with claim 3, wherein the margin of the closure piece and the margin of the surrounding metallic lid surface are offset from one another by a height offset of 0.05 mm to 0.12 mm.

13. The can lid in accordance with claim 4, wherein the margin of the closure piece and the margin of the surrounding metallic lid surface are offset from one another by a height offset which amounts to at least 25% and at most 70% of the thickness of the metallic lid surface.

14. The can lid in accordance with claim 1, wherein the closure piece is held in the surrounding metallic lid surface by clamping.

15. The can lid in accordance with claim 9, wherein the weakening is one of a notch and an at least partial opening notch.

* * * * *